United States Patent [19]

Murakami et al.

[11] 4,210,517

[45] Jul. 1, 1980

[54] PREPARATION OF CARBONACEOUS PRODUCTS

[75] Inventors: Hisashi Murakami, Tokyo; Toshikatsu Ohtsubo, Kamishirakawa; Kenji Fukuda, Omuta; Noriaki Ohnishi, Ogawa, all of Japan

[73] Assignees: Mitsui Mining Co. Ltd.; Mitsui Coke Co. Ltd., both of Tokyo, Japan

[21] Appl. No.: 943,070

[22] Filed: Sep. 18, 1978

[30] Foreign Application Priority Data

| | | | |
|---|---|---|---|
| Oct. 31, 1977 | [JP] | Japan | 52-129709 |
| Oct. 31, 1977 | [JP] | Japan | 52-129710 |
| Oct. 31, 1977 | [JP] | Japan | 52-129711 |
| Oct. 31, 1977 | [JP] | Japan | 52-129712 |
| Oct. 31, 1977 | [JP] | Japan | 52-129713 |

[51] Int. Cl.[2] ..... C10G 1/00; C10G 1/06; C10B 57/04; C10G 9/14

[52] U.S. Cl. ..... 208/8 LE; 208/10; 201/23; 208/131

[58] Field of Search ..... 208/8 LE, 10, 131; 201/23

[56] References Cited

U.S. PATENT DOCUMENTS

| | | | |
|---|---|---|---|
| 3,884,794 | 5/1975 | Bull et al. | 208/10 X |
| 3,997,426 | 12/1976 | Montagna et al. | 208/10 |
| 4,132,628 | 1/1979 | Pell | 208/10 X |

*Primary Examiner*—Delbert E. Gantz
*Assistant Examiner*—William G. Wright

[57] ABSTRACT

Coal is dissolved in a hydrocarbon solvent, heated and purged of insolubles to form various types of solvent purified coal having different degrees of depolymerization. These various types of solvent purified coal are then coked to yield a variety of green coke products. The solvent purified coal is useful as a raw material for needle-like green coke when the value of its (N+O+S)/C atomic ratio is less than 0.0445; for coarse mosaic green coke when the value is in the range of from 0.0445 to but excluding 0.0516; for mosaic green coke when the value is in the range of from 0.0516 to but excluding 0.0584; for fine mosaic green coke when the value is in the range of from 0.0584 to but excluding 0.0645; and for glassy green coke when the value is equal to or greater than 0.0645.

16 Claims, 5 Drawing Figures

PREPARATION OF CARBONACEOUS PRODUCTS

BACKGROUND OF THE INVENTION

This invention relates to the preparation of carbonaceous products from coal. More particularly, it relates to a process for the preparation of green coke products, such as needle-like carbon, coarse mosaic carbon, mosaic carbon, fine mosaic carbon, and glassy carbon, from various types of solvent purified coal formed by dissolving coal in a hydrocarbon solvent, separating insoluble components from the resulting solution, and then removing the solvent therefrom, each type of solvent purified coal being characterized by the (N+O+S)/C atomic ratio thereof having a value in the range specified for one of the foregoing carbonaceous products.

The term "coal" as used herein is intended to comprehend all kinds of coal including bituminous coal, subbituminous coal, brown coal, lignite, and grass peat.

The properties of carbonaceous products prepared according to conventional methods are determined solely by the type of raw material used. In industrial applications, petroleum derived heavy oil has been exclusively used as a raw material for needle-like carbon, coarse mosaic carbon, mosaic carbon, and fine mosaic carbon. However, petroleum derived heavy oil is steeply rising in price and, moreover, remarkably lowering in quality. Meanwhile, thermosetting resins such as furfuryl alcohol and furan resin have been used for the preparation of glassy carbon which is an impermeable carbonaceous product useful for the lining of reactors and the like. However, these resins are expensive. Under these circumstances, the supply-demand relations of such carboneous products are becoming more and more strained. Accordingly, there is urgent need of a process for the preparation of such carbonaceous products from a raw material which will be stably and inexpensively available over a long period of time.

Coal, which has a considerable ash content, cannot be used directly as a raw material for such carbonaceous products. It is possible, however, to make coal useful as a raw material for such carbonaceous products by depolymerizing it in a hydrocarbon solvent and separating insoluble components therefrom. When a variety of carbonaceous products as described above are to be prepared from coal, the problem to be solved is how far the depolymerization of coal in a hydrocarbon solvent should be allowed to proceed for the purpose of obtaining a raw material suitable for the preparation of a desired carbonaceous product.

SUMMARY OF THE INVENTION

It is an object of this invention to provide a process for the preparation of desired useful green coke products from coal.

It is another object of this invention to provide an improved process for the preparation of desired useful green coke products by making use of inexpensive and abundant carbon sources such as brown coal and lignite.

A further object of this invention is to provide an improved process for the preparation of green coke products of desired structure by using the solvent purified coal of a predetermined (N+O+S)/C atomic ratio.

Other objects, features and advantages of this invention will appear more fully from the following detailed description thereof.

In a process for the preparation of needle-like green coke, coarse mosaic green coke, mosaic green coke, fine mosaic green coke, or glassy green coke from coal, the coal is dissolved in a hydrocarbon solvent to form a solution of coal having a predetermined degree of depolymerization. After the residual insoluble components are separated from the solution, the solvent is removed to leave the desired type of solvent purified coal. Then, the solvent purified coal is coked to yield one of the foregoing green coke. The improvement provided by this invention comprises selecting the solvent purified coal from the group consisting of a first type of solvent purified coal useful as a raw material for structurally needle-like green coke and characterized by the (N+O+S)/C atomic ratio thereof having a value less than 0.0445, a second type of solvent purified coal useful as a raw material for structurally coarse mosaic green coke and characterized by the (N+O+S)/C atomic ratio thereof having a value in the range of from 0.0445 to but excluding 0.0516, a third type of solvent purified coal useful as a raw material for structurally mosaic green coke and characterized by the (N+O+S)/C atomic ratio thereof having a value in the range of from 0.0516 to but excluding 0.0584, a fouth type of solvent purified coal useful as a raw material for structurally fine mosaic green coke and characterized by the (N+O+S)/C atomic ratio thereof having a value in the range of from 0.0584 to but excluding 0.0645, or a fifth type of solvent purified coal useful as a raw material for structurally glassy green coke and characterized by the (N+O+S)/C atomic ratio thereof having a value equal to or greater than 0.0645.

DETAILED DESCRIPTION OF THE INVENTION

Figure 2:
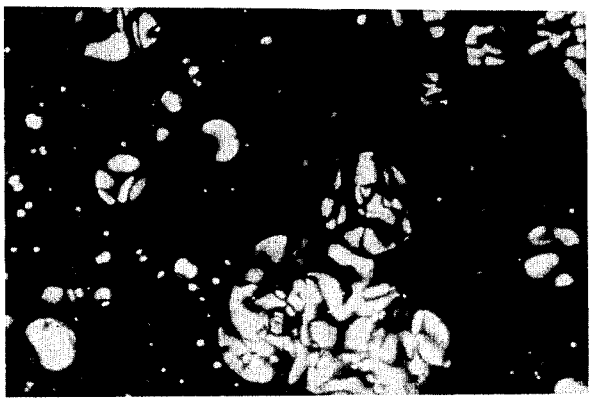
FIG. 2 is a photomicrograph of coarse mosaic green coke prepared in accordance with this invention.

The gas prepared by dissolving coal in a hydrocarbon solvent contains large amounts of carbon monoxide, carbon dioxide, hydrogen sulfide, and ammonia. This suggests that the depolymerization reaction taking place during the dissolution of coal is based on fundamental reactions such as elimination of aliphatic side chains from the structural units of coal, severence of three-dimensional crosslinkages, and the like. As a consequence of the depolymerization reaction, the resulting solvent purified coal contains decreased amounts of hetero atoms such as nitrogen, oxygen, and sulfur atoms. This indicates that the degree of depolymerization of the solvent purified coal can be estimated from the contents of nitrogen, oxygen, and sulfur in the resulting solvent purified coal and, in other words, the carbonization properties of the solvent purified coal can be predicted on the basis of its (N+O+S)/C atomic ratio.

Various types of solvent purified coal useful as raw materials for a variety of green coke products can be formed according to the known processes which are given hereinafter. It is obvious, however, that purified coals formed in any other process may be used in the practice of the invention as long as they possess the required atomic ratio.

(A) Coal is dispersed in a hydrocarbon solvent, heated to a temperature of 350° C. or above under a hydrogen pressure of at least 30 kg/cm$^2$G, and held at that temperature for a sufficient period of time to dissolve the coal in the solvent. Then, insoluble components are separated from the resulting solution of coal. The temperature employed for the dissolution of the coal is preferably in the range of from 350° to 450° C. The solvent is selected from the group consisting of fractions obtained from coal-derived heavy oil, petroleum-derived heavy oil, or mixtures thereof by distillation in a temperature range of from 180° to 420° C., and preferably used in an amount, on a weight basis, equal to from 1 to 5 parts per part of the coal. The time required for the coal to be dissolved in the solvent by the application of heat depends on the desired value of the (N+O+S)/C atomic ratio of the resulting solvent purified coal.

(B) Coal is dispersed in a hydrocarbon solvent and water is introduced thereinto. The mixture is heated to a temperature of 350° C. or above under a carbon monoxide pressure of at least 30 kg/cm$^2$G, and held at that temperature for a sufficient period of time to dissolve the coal in the solvent. In the dissolution, carbon monoxide reacts with water to form hydrogen and carbon dioxide. The thus-obtained hydrogen takes part in the hydrogenation reaction as in the above-mentioned process (A). Then, insoluble components are separated from the resulting solution of coal. The type and amount of solvent used may be the same as described in the procedure A. The water is preferably used in an amount equal to at least 1 mole per mole of the carbon monoxide, and the carbon monoxide is preferably used in an amount, on a dry ash-free weight basis (hereinafter referred to as "d.a.f."), equal to at least 0.2 part per part of the coal. The temperature employed for the dissolution of the coal is preferably in the range of from 350° to 450° C. The time required for the dissolution of the coal depends on the desired value of the (N+O+S)/C atomic ratio of the resulting solvent purified coal.

(C) Coal is extracted with a hydrocarbon solvent at a temperature of from 350° to 430° C. The solvent is selected from the group consisting of fractions obtained from coal derived heavy oil, petroleum derived heavy oil, and mixtures thereof by distillation in a temperature range of from 180° to 420° C., and used in an amount equal to at least 4 times the weight of the coal. The time required for the extraction of the coal depends on the desired value of the (N+O+S)/C atomic ratio of the resulting solvent purified coal.

(D) Coal is dispersed in a hydrocarbon solvent and stannic chloride is added thereto as a catalyst in an amount equal to 3% by weight based on the weight of the coal. Under a hydrogen pressure of at least 30 kg/cm$^2$G, the mixture is treated in the same manner as described in the procedure A.

The time required for producing a desired solvent purified coal may be varied depending on the process used, the kind of raw material coal adopted and other operation conditions. For example, according to the above-mentioned process (A), wherein sub-bituminous coal with a water content of 20% by weight and a (N+O+S)/C atomic ratio of 0.2022 is dissolved, as it is or after being dried, in a solvent at 410° C. and under a hydrogen pressure of 60 kg/cm$^2$G, time for obtaining the desired solvent purified coal may be at least 4 hours when the desired value of a (N+O+S)/C of the solvent purified coal is less than 0.0445; in the range of from 2 to but excluding 4 hours when the desired value is in the range of from 0.0445 to but excluding 0.0516; in the range of from 1 to but excluding 2 hours when the desired value is in the range of from 0.0516 to but excluding 0.0584; in the range of from 0.5 to but excluding 1 hour when the desired value is in the range of from 0.0584 but excluding 0.0645; and less than 0.5 hour when the desired value is at least 0.0645.

According to the above-mentioned process (B), wherein lignite with a water content of 60% by weight and a (N+O+S)/C atomic ratio of 0.3434 is dissolved, after being dried, in a solvent in the presence of water in an amount of 2 mol per mole of carbon monoxide used, at 390° C. and under a carbon monoxide pressure of 60 kg/cm$^2$G, the time for obtaining the desired green coke may be range of from 4 to but excluding 8 hours when the desired value of a (N+O+S)/C of the solvent purified coal is in the range of from 0.0516 to but excluding 0.0584; from 2 to but excluding 4 hours when the desired value is in the range of from 0.0584 to but excluding 0.0645; less than 2 hours when the desired value is at least 0.0645.

According to the above-mentioned process (C), wherein bituminous coal with a water content of 1.7% by weight and a (N+O+S)/C atomic ratio of 0.0830 is dissolved in a coal-derived tar middle oil at 420° C., the time for obtaining the desired solvent purified coal may range from 1 to but excluding 2 hours when the desired value of a (N+O+S)/C of the solvent purified coal is in the range of from 0.0445 to but excluding 0.0516; from 0.5 to but excluding 1 hour when the desired value is in the range of from 0.0516 to but excluding 0.0584; from 0.25 to 0.5 hour when the desired value is in the range of from 0.0584 to but excluding 0.0645; less than 0.25 hour when the desired value is at least 0.0645.

In order to obtain a desired solvent purified coal most economically, the above-mentioned process (A), (B) or (C) can be adopted independently, and alternatively any combination of these processes can be also adopted depending on the properties of the raw material coal to be used.

The solvent purified coal obtained according to any of the above-described procedure can be easily converted, according to the known coking method, into the green coke which is determined by the value of its (N+O+S)/C atomic ratio. More particularly, the solvent purified coal is useful as a raw material for needle-like green coke when the value is less than 0.0445; for coarse mosaic green coke when the value is in the range of from 0.0445 to but excluding 0.0516; for mosaic green coke when the value is in the range of from 0.0516 to but excluding 0.0584; for fine mosaic green coke when the value is in the range of from 0.0584 to but excluding 0.0645; and for glassy carbon when the value is equal to or greater than 0.0645. The temperature for coking is preferablly in the range of from 420° to 520° C.

It has been found that the following process is most preferable to easily coke the solvent purified coal into the green coke of disired structure. Prior to coking, this solvent purified coal may be subjected to first heat-treatment (preferably at a temperature of from 370° to 470° C.) to form an intermediate product. This heat-treatment technique allows the solvent purified coal to be readily converted into a green coke of desired structure without hindering the process of coking. That is, the solvent purified coal is preliminarily heat-treated for a period of not less than 0.5 hour. The temperature employed for this purpose is preferably equal to or at most 20° C. higher than the temperature employed for the dissolution of the coal (namely, the temperature at which the coal was depolymerized in the solvent or extracted with the solvent). If the temperature employed for the heat-treatment exceeds that employed for the dissolution of the coal by more than 20° C., the heat-treated product will not only tend to foam or bump due to its rapid thermal decomposition but also contribute to a number of drawbacks such as the formation of cloggings within the apparatus. The temperature employed for the heat treatment is preferably in the range of from 370° to 470° C. and more preferably in the range of from 400° to 450° C.

The resulting heat-treated product may now be coked by heating it at a higher temperature, (for example, from 420° to 520° C.) to obtain green coke.

A calcined coke can be obtained by calcining the above-described green coke at a higher temperature, for example, a temperature of from 1,000° to 1,500° C. By graphitizing the thus-obtained calcined coke at a temperature of from 2,500° to 3,000° C., a artificial graphite can be formed.

Both the thus-obtained calcined coke and artificial graphite have the same structure as that of the starting green coke.

To further illustrate the practice of the present process for the preparation of various carbonaceous products, the following illustrative, but not limitative examples are given. All pressures are gauge pressures unless otherwise indicated.

Example 1 (Preparation of Needle-like Green Coke)

(a) Formation of Solvent Purified Coal

Into a 1-liter autoclave equipped with a stirrer were charged 100 g of Australian sub-bituminous coal ground into 60-mesh or finer powder and 300 g of tar middle oil having a boiling range of 200°–400° C. These ingredients were stirred and mixed to form a slurry.

After a hydrogen pressure of 60 kg/cm$^2$ was established within the autoclave, the contents were heated to 410° C. at a rate of 3.3° C./min., held at that temperature for 4 hours, and then cooled to room temperature. The resulting solution was filtered under reduced pressure and then distilled in vacuo to recover the solvent, whereby solvent purified coal was obtained. The conditions of formation and the composition of the solvent purified coal were as follows:

Time held at 410° C.: 4 hours
Degree of conversion: 70% by weight (d.a.f.)
Value of (N+O+S)/C atomic ratio: 0.0432

(b) Conversion into Needle-like Green Coke

The solvent purified coal obtained by the above-described procedure was converted into green coke by heating it at 430° C. for 15 hours. The structure of the green coke was needle-like. The expression "needle-like" means that the green coke exhibited a flow structure at the stage of heating.

Figure 1:
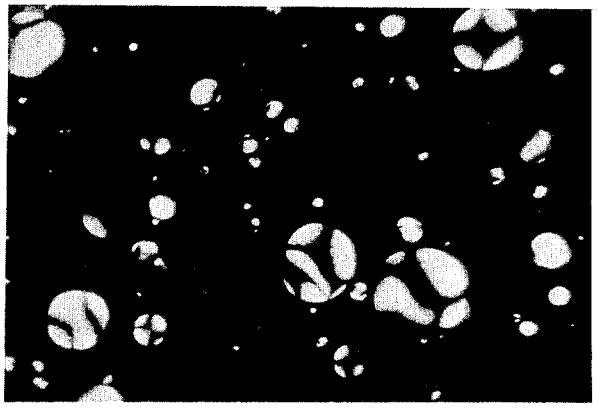
FIG. 1 is a photomicrograph of needle-like green coke prepared in accordance with this invention.

A photomicrograph of the needle-like green coke is shown in FIG. 1.

The green coke was then calcined at 1,350° C. for 60 minutes to yield calcined coke. The true specific gravity of calcined coke was 2.108. The true specific gravity of the calcined coke was determined according to the "Method of Measurement Based on Replacement by Toluene".

An electrode was fabricated of the above calcined coke and its coefficient of thermal expansion was evaluated. The conditions of fabrication and the result of evaluation were as follows:

Baking temperature: 1,000° C.
Weight ratio of calcined coke to medium soft pitch: 4:1
Coefficient of thermal expansion: $1.2\times10^{-6}$/°C.

The calcined coke was further heated at 2,800° C. for 1 hour to yield artificial graphite. The properties of the artificial graphite were as follows:

| X-ray parameters (Å) of artificial graphite: | | |
|---|---|---|
| Co (002) | Lc (002) | La (110) |
| 6,732 | >1,000 | >1,000 |

Example 2 (Preparation of Needle-like Green Coke)

(a) Formation of Solvent Purified Coal

Into a 1-liter autoclave equipped with a stirrer were charged 100 g of Australian lignite (with a water content of 6.2%) ground into 60-mesh or finer powder, 300 g of tar middle oil having a boiling range of 200°–400° C., and 0.973 g of stannic chloride dihydrate as a catalyst. These ingredients were stirred and mixed to form a slurry.

After a hydrogen pressure of 60 kg/cm$^2$ was established within the autoclave, the contents were heated to 380° C. at a rate of 3.3° C./min., held at that temperature of 4 hours, and then cooled to room temperature. The resulting mixture was filtered under reduced pressure and then distilled in vacuo to recover the solvent, whereby solvent purified coal was obtained. The conditions of formation and the composition of the solvent purified coal were as follows:

Time held at 380° C.: 4 hours
Degree of conversion: 92.8% by weight (d.a.f.)
Value of (N+O+S)/C atomic ratio: 0.0390

(b) Conversion into Needle-like Green Coke

The solvent purified coal obtained by the above-described procedure was converted into green coke by heating it at 400° C. for 5 hours and then 430° C. for 12 hours. The structure of the thus-obtained green coke was needle-like.

Example 3 (Preparation of Coarse Mosaic Green Coke)

(a) Formation of Solvent Purified Coal

Into a 1-liter autoclave equipped with a stirrer were charged 100 g of Australian sub-bituminous coal ground into 60-mesh or finer powder and 300 g of tar middle oil having a boiling range of 200°–400° C. These ingredients were stirred and mixed to form a slurry.

After a hydrogen pressure of 60 kg/cm$^2$ was established within the autoclave, the contents were heated to 410° C. at a rate of 3.3° C./min., held at that temperature for 2 hours, and then cooled to room temperature. The resulting solution was filtered under reduced pressure and then distilled in vacuo to recover the solvent, whereby solvent purified coal was obtained. The conditions of formation and the composition of the solvent purified coal were as follows:

Time held at 410° C.: 2 hours
Degree of conversion: 72% by weight (d.a.f.)

Value of (N+O+S)/C atomic ratio: 0.0484

(b) Conversion into Coarse Mosaic Green Coke

The solvent purified coal obtained by the above-described procedure was converted into green coke by heating it at 430° C. for 15 hours.

The structure of the thus-obtained green coke was coarse mosaic. The expression "coarse mosaic" means that, at the stage of heating, the green coke exhibited a mosaic structure including spherulites of diameter more than 10μ.

A photomicrograph of the coarse mosaic green coke is shown in FIG. 2.

The thus-obtained green coke was then calcined at 1,350° C. for 60 minutes to yield calcined coke. The true specific gravity of calcined coke was 2.104.

An electrode was fabricated of the above calcined coke and its coefficient of thermal expansion was evaluated. The conditions of fabrication and the result of evaluation were as follows:

Baking temperature: 1,000° C.

Weight ratio of calcined coke to medium soft pitch: 4:1

Coefficient of thermal expansion: $2.2\times10^{-6}$/°C.

The calcined coke was heated at 2,800° C. for 1 hour to yield artificial graphite. The properties of the artificial graphite were as follows:

| X-ray parameters (Å) of artificial graphite: | | |
|---|---|---|
| Co (002) | Lc (002) | La (110) |
| 6,739 | 550 | 1,000 |

Example 4 (Preparation of Mosaic Green Coke)

(a) Formation of Solvent Purified Coal

Into a 1-liter autoclave equipped with a stirrer were charged 100 g of Australian sub-bituminous coal ground into 60-mesh or finer powder and 300 g of tar middle oil having a boiling range of 200°–400° C. These ingredients were stirred and mixed to form a slurry.

After a hydrogen pressure of 60 kg/cm$^2$ was established within the autoclave, the contents were heated to 410° C. at a rate of 3.3° C./min., held at that temperature for 1 hour, and then cooled to room temperature.

The resulting solution was filtered under reduced pressure and then distilled in vacuo to recover the solvent, whereby solvent purified coal was obtained. The conditions of formation and the composition of the solvent purified coal were as follows:

Time held at 410° C.: 1 hour

Degree of conversion: 73% by weight (d.a.f.)

Value of (N+O+S)/C atomic ratio: 0.0570

(b) Conversion into Mosaic Green Coke

The solvent purified coal obtained by the above-described procedure was converted into green coke by heating it at 430° C. for 15 hours. The structure of the thus-obtained green coke was mosaic. The expression "mosaic" means that, at the stage of heating, the green coke exhibited a mosaic structure including spherulites of diameter from 1 to 10μ.

Figure 3:
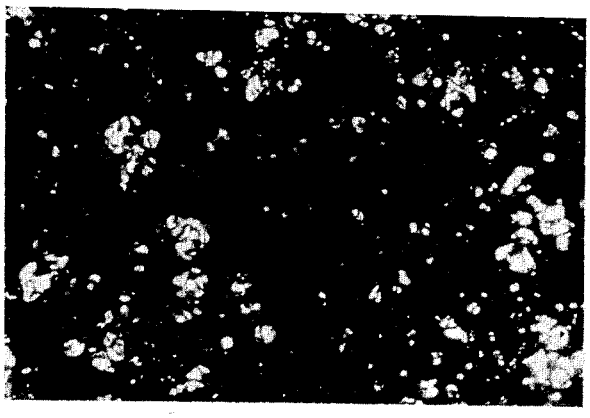
FIG. 3 is a photomicrograph of mosaic green coke prepared in accordance with this invention.

A photomicrograph of the mosaic green coke thus obtained is shown in FIG. 3.

The thus-obtained green coke was then calcined at 1,350° C. for 60 minutes to yield calcined coke. The true specific gravity of calcined coke was 2.054.

An electrode was fabricated of the above calcined coke and its coefficient of thermal expansion was evaluated. The conditions of fabrication and the result of evaluation were as follows:

Baking temperature: 1,000° C.

High ratio of calcined coke to medium soft pitch: 4:1

Coefficient of thermal expansion: $4.3\times10^{-6}$/°C.

The calcined coke was further heated at 2,800° C. for 1 hour to yield artificial graphite. The properties of the artificial graphite were as follows:

| X-ray parameters (Å) of artificial graphite: | | |
|---|---|---|
| Co (002) | Lc (002) | La (110) |
| 6,746 | 440 | 810 |

EXAMPLE 5 (Preparation of Mosaic Green Coke)

(a) Formation of Solvent Purified Coal

Into a 5-liter autoclave equipped with a stirrer were charged 500 g of Australian lignite (with a water content of 6.2%) ground into 30-mesh or finer powder, 1,500 g of tar middle oil having a boiling range of 200°–400° C., 149 g of water, and 20 g of sodium hydrogencarbonate. These ingredients were stirred and mixed to form a slurry.

After a carbon monoxide pressure of 60 kg/cm$^2$ was established within the autoclave, the contents were heated to 380° C. at a rate of 3.3° C./min., held at that temperature for 4 hours, and then cooled to room temperature. The resulting solution was filtered under reduced pressure and then distilled in vacuo to recover the solvent, whereby solvent purified coal was obtained. The conditions of formation and the composition of the solvent purified coal were as follows:

Time held at 380° C.: 4 hours

Degree of conversion: 84.2% by weight (d.a.f.)

Value of (N+O+S)/C atomic ratio: 0.0519

(b) Conversion into Mosaic Green Coke

The solvent purified coal obtained by the above-described procedure was converted into green coke by heating it at 400° C. for 5 hours and then at 430° C. for 12 hours. The structure of the resulting green coke was mosaic.

Example 6 (Preparation of Mosaic Green Coke)

(a) Formation of Solvent Purified Coal

Into a 1-liter autoclave equipped with a stirrer were charged 100 g of Australian lignite (with a water content of 6.2%) ground into 60-mesh or finer powder, 300 g of tar middle oil having a boiling range of 200°–400° C., and 0.973 g of stannic chloride dihydrate as a catalyst. These ingredients were stirred and mixed to form a slurry.

After a hydrogen pressure of 60 kg/cm$^2$ was established within the autoclave, the contents were heated to 380° C. at a rate of 3.3° C./min., held at that temperature for 1 hour, and then cooled to room temperature. The resulting solution was filtered under reduced pressure and then distilled in vacuo to recover the solvent, whereby solvent purified coal was obtained. The conditions of formation and the composition of the solvent purified coal were as follows:

Time held at 380° C.: 1 hour

Degree of conversion: 76.0% by weight (d.a.f.)

Value of (N+O+S)/C atomic ratio: 0.0527

(b) Conversion into Mosaic Green Coke

The solvent purified coal obtained by the above-described procedure was converted into green coke by heating it at 400° C. for 5 hours and then at 430° C. for 12 hours. The structure of the resulting green coke was mosaic.

Example 7 (Preparation of Mosaic Green Coke)

(a) Formation of Solvent Purified Carbon

Into a 1-liter autoclave equipped with a stirrer were charged 100 g of Japanese bituminous coal ground into 60 mesh or finer powder and 300 g of tar middle oil having a boiling range of 200°–400° C. These ingredients were stirred and mixed to form a slurry.

After a hydrogen pressure of 30 kg/cm$^2$ was established within the autoclave, the contents were heated to 420° C. for 30 min., and then cooled to room temperature. The resulting mixture was filtered under reduced pressure and then distilled in vacuo to recover the solvent, whereby solvent purified coal was obtained. The conditions of formation and the composition of the solvent purified coal were as follows.

Time held at 420° C.: 30 min.
Degree of conversion: 92% by weight (d.a.f.)
Value of (N+O+S)/C atomic ratio: 0.0577

(b) Conversion into Mosaic Green Coke

The solvent purified coal obtained by the above-described procedure was converted into green coke by heating it at 430° C. for 15 hours. The structure of the resulting green coke was mosaic.

Example 8 (Preparation of Fine Mosaic Green Coke)

(a) Formation of Solvent Purified Carbon

Into a 1-liter autoclave equipped with a stirrer were charged 100 g of Australian sub-bituminous coal ground into 60-mesh or finer powder and 300 g of tar middle oil having a boiling range of 200°–400° C. These ingredients were stirred and mixed to form a slurry.

After a hydrogen pressure of 60 kg/cm$^2$ was established within the autoclave, the contents were heated to 410° C. at a rate of 3.3° C./min., held at that temperature for 30 minutes, and then cooled to room temperature. The resulting solution was filtered under reduced pressure and then distilled in vacuo to recover the solvent, whereby solvent purified coal was obtained. The conditions of formation and the composition of the solvent purified coal were as follows:

Time held at 410° C.: 30 minutes
Degree of conversion: 72% by weight (d.a.f.)
Value of (N+O+S)/C atomic ratio: 0.0622

(b) Conversion into Fine Mosaic Green Coke

The solvent purified coal obtained by the above-described procedure was converted into green coke by heating it at 430° C. for 15 hours. The structure of the green coke was fine mosaic. The expression "fine mosaic" means that, at the stage of heating, the green coke exhibited amosaic structure including spherulites of diameter less than 1$\mu$.

Figure 4:
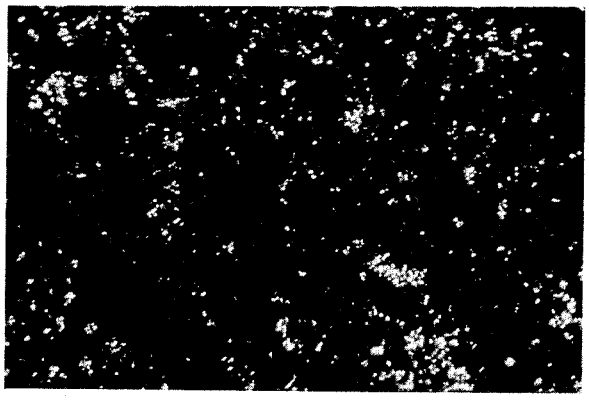
FIG. 4 is a photomicrograph of fine mosaic green coke prepared in accordance with this invention.

A photomicrograph of the fine mosaic green coke is shown in FIG. 4.

The green coke was then calcined at 1,350° C. for 60 minutes to yield calcined coke. The true specific gravity of calcined coke was 2.003.

The calcined coke was heated at 2,800° C. for 1 hour to yield artifical graphite. The properties of the artificial graphite were as follows:

| X-ray parameters (A) of artificial graphite: | | |
|---|---|---|
| Co (002) | Lc (002) | La (110) |
| 6,757 | 310 | 604 |

The green coke obtained by heating the same solvent purified coal at 430° C. for 2 hours exhibited a fine mosaic structure. This green coke was ground into 100-mesh or finer powder, molded under a pressure of 2 t/cm$^2$ without using any binder, and then baked at 1,000° C. The compressive strength, bulk density, apparent porosity, and gas permeability of the baked product were as follows:

Compressive strength: $\perp$2.90 t/cm$^2$; $\|$ 2.88 t/cm$^2$
Bulk density: 1.65 g/cm$^3$
Apparent porosity: 7%
Gas permeability: $7\times10^{-10}$ cm$^3$/sec.

Example 9 (Preparation of Fine Mosaic Green Coke)

(a) Formation of Solvent Purified Coal

Into a 1-liter autoclave equipped with a stirrer were charged 100 g of Japanese bituminous coal ground into 60-mesh or finer powder and 400 g of tar middle oil having a boiling range of 185°–225° C. These ingredients were stirred and mixed to form a slurry.

After the air within the autoclave was replaced by argon, the contents were heated to 420° C. at a rate of 3.3° C./min. At 420° C., a pressure of 32 kg/cm$^2$ was established due solely to the vapor pressure of the solvent. Upon reaching that temperature, the contents were immediately cooled to room temperature. The resulting solution was filtered under reduced pressure and then distilled in vacuo to recover the solvent, whereby solvent purified coal was obtained. The degree of conversion of the coal and the composition of the solvent purified coal were as follows:

Degree of conversion: 62% by weight (d.a.f.)
Value of (N+O+S)/C atomic ratio: 0.0602

(b) Conversion into Fine Mosaic Green Coke

The solvent purified coal obtained by the above-described procedure was converted into green coke by heating it at 430° C. for 12 hours. The structure of the resulting green coke was fine mosaic. The green coke was then calcined at 1,350° C. for 1 hour to yield calcined coke. The true specific gravity of calcined coke was 2.031.

Example 9 (Preparation of Glassy Green Coke)

(a) Formation of Solvent Purified Coal

Into a 1-liter autoclave equipped with a stirrer were charged 100 g of Australian sub-bituminous coal ground into 60-mesh or finer powder and 300 g of tar middle oil having a boiling range of 200°–400° C. These ingredients were stirred and mixed to form a slurry.

After a hydrogen pressure of 60 kg/cm$^2$ was established within the autoclave, the contents were heated to 410° C. at a rate of 3.3° C./min. and immediately cooled to room temperature. The resulting solution was filtered under reduced pressure and then distilled in vacuo to recover the solvent, whereby solvent purified coal was obtained. The conditions of formation and the composition of the solvent purified coal were as follows:

Degree of conversion: 72% by weight (d.a.f.)
Value of (N+O+S)/C atomic ratio: 0.0667

(b) Conversion into Glassy Green Carbon

The solvent purified coal obtained by the above-described procedure was converted into green coke by heating it at 410° C. for 3 hours and then at 430° C. for 15 hours. The strucuture of the resulting green coke was glassy. The expression "glassy" means that, at the stage of heating, the green coke exhibited a glassy structure including no spherulites.

Figure 5:
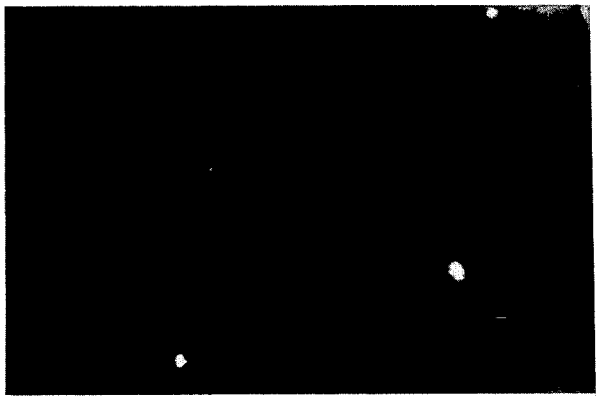
FIG. 5 is a photomicrograph of glassy green coke prepared in accordance with this invention.

A photomicrograph of the glassy green coke thus obtained is shown in FIG. 5.

The green coke was then calcined at 1,350° C. for 1 hour to yield calcined coke. The true specific gravity of calcined coke was 1.920.

The calcined coke was heated at 2,800° C. for 1 hour to yield artificial graphite. The properties of the artifical graphite were as follows:

| X-ray parameters (A) of artificial graphite: | | |
|---|---|---|
| Co (002) | Lc (002) | La (110) |
| 6,795 | 250 | 210 |

The green coke obtained by heating the same solvent purified coal at 410° C. for 3 hours and then at 430° C. for 2 hours exhibited a glassy structure. This green coke was ground into 100-mesh or finer powder, molded under a pressure of 2 t/cm$^2$ without using any binder, and then baked at 1,000° C. The compressive strength, bulk density, apparent porosity, and gas permeability of the baked product were as follows:
Compressive strength: $\perp$2.81 t/cm$^2$; $\parallel$ 2.82 t/cm$^2$
Bulk density: 1.52 g/cm$^3$
Apparent porosity: 3%
Gas permeability: $1\times10^{-10}$ cm$^3$/sec.

Example 11 (Preparation of Glassy Green Coke)

(a) Formation of Solvent Purified Coal

Into a 5-liter autoclave equipeed with a stirrer were charged 500 g of Australian lignite (with a water content of 6.2%) ground into 30-mesh or finer powder, 1,500 g of tar middle oil having a boiling range of 200°–400° C., 149 g of water, and 20 g of sodium hydrogencarbonate. These ingredients were stirred and mixed to form a slurry.

After a carbon monoxide pressure of 60 kg/cm$^2$ was established within the autoclave, the contents were heated to 380° C. at a rate of 3.3° C./min., held at that temperature for 2 hour, and then cooled to room temperature. The resulting solution was filtered under reduced pressure and then distilled in vacuo to recover the solvent, whereby solvent purified coal was obtained. The conditions of formation and the composition of the solvent purified coal were as follows:
Time held at 380° C.: 1 hour
Degree of conversion: 88.0% by weight (d.a.f.)
Value of (N+O+S)/C atomic ratio: 0.0645

(b) Conversion into Glassy Green Coke

The solvent purified coal obtained by the above-described procedure was converted into green coke by heating it at 400° C. for 5 hours and then at 430° C. for 12 hours. The strucutre of the resulting green coke was glassy.

Example 12 (Preparation of Glassy Green Coke)

(a) Formation of Solvent Purified Coal

Into a 1-liter autoclave equipped with a stirrer were charged 100 g of Australian lignite (with a water content of 6.2%) ground into 60-mesh or finer powder, 300 g of tar middle oil having a boiling range of 200°–400° C., and 0.973 g of stannic chloride dihydrate as a catalyst. These ingredients were stirred and mixed to form a slurry.

After a hydrogen pressure of 60 kg/cm$^2$ was established within the autoclave, the contents were heated to 380° C. at a rate of 3.3° C./min. and immediately cooled to room temperature. The resulting solution was filtered under reduced pressure and then distilled in vacuo to recover the solvent, whereby solvent purified coal was obtained. The conditions of formation and the composition of the solvent purified coal were as follows:
Degree of conversion: 68.7% by weight (d.a.f.)
Value of (N+O+S)/C atomic ratio: 0.0653

(b) Conversion into Glass Green Coke

The solvent purified coal obtained by the above-described procedure was converted into green coke by heating it at 400° C. for 5 hours and then at 430° C. for 12 hours. The structure of the resulting green coke was glassy.

Example 13 (Preparation of Glassy Green Coke)

(a) Formation of Solvent Purified Coal

Into a 5-liter autoclave equipped with a stirrer were charged 500 g of Australian lignite (with a water content of 6.2%) ground into 30-mesh or finer power, 1,500 g of tar middle oil having a boiling range of 200°–400° C., 149 g of water, and 20 g of sodium hydrogencarbonate. These ingredients were stirred and mixed to form a slurry.

After a carbon monoxide pressure of 30 kg/cm$^2$ was established within the autoclave, the contents were heated to 380° C. at a rate of 3.3° C./min., held at that temperature for 2 hours, and then cooled to room temperature. The resulting solution was filtered under reduced pressure and then distilled in vacuo to recover the solvent, whereby solvent purified coal was established. The condition of formation and the composition of the solvent purified coal was as follows:
Time held at 380° C.: 2 hours
Degree of conversion: 82.1% by weight (d.a.f.)
Value of (N+O+S)/C atomic ratio: 0.0664

(b) Conversion into Glassy Green Coke

The solvent purified coal obtained by the above-described procedure was converted into green coke by heating 400° C. for 5 hours and then at 430° C. for 12 hours. The structure of the green coke thus obtained was glassy.

What is claimed is:

1. In a process for the preparation of a green coke having a structure selected from the group consisting of needle-like, coarse-mosaic, mosaic, fine mosaic and glassy, wherein coal is dissolved in a hydrocarbon solvent to form a solution of coal having a predetermined degree of depolymerization, residual insoluble components are separated from said solution, said solvent is removed therefrom to yield a solvent purified coal useful as a raw material for said green coke, and said solvent purified coal is coked to form said green coke, the improvement wherein said solvent purified coal is selected from the group consisting of a first type of solvent purified coal useful as a raw material for structurally needle-like green coke and characterized by a (N+O+S)/C atomic ratio of less than 0.0445, a second type of solvent purified coal useful as a raw material for structurally coarse mosaic green coke and characterized by a (N+O+S)/C atomic ratio of from 0.0445 to but excluding 0.0516, a third type of solvent purified coal useful as a raw material for structurally mosaic green coke and characterized by a (N+O+S)/C atomic ratio of from 0.0516 to but excluding 0.0584, a fourth type of solvent purified coal useful as a raw material for structurally fine mosaic green coke and characterized by a (N+O+S)/C atomic ratio of from 0.0584 to but excluding 0.0645, and a fifth type of solvent purified coal useful as a raw material for structurally glassy green coke and characterized by a (N+O+S)/C atomic ratio equal to or greater than 0.0645.

2. A process as claimed in claim 1 wherein said solvent purified coal is a first type of solvent purified coal useful as a raw material for structurally needle-like green coke and characterized by a (N+O+S)/C atomic ratio of less than 0.0445.

3. A process as claimed in claim 1 wherein said solvent purified coal is a second type of solvent purified coal useful as a raw material for structurally coarse mosaic green coke and characterized by a (N+O+S)/C atomic ratio of from 0.0445 to but excluding 0.0516.

4. A process as claimed in claim 1 wherein said solvent purified coal is a third type of solvent purified coal useful as a raw material for structurally mosaic green coke and characterized by a (N+O+S)/C atomic ratio of from 0.0516 to but excluding 0.0584.

5. A process as claimed in claim 1 wherein said solvent purified coal is a fourth type of solvent purified coal useful as a raw material for structurally fine mosaic green coke and characterized by a (N+O+S)/C atomic ratio of from 0.0584 to but excluding 0.0645.

6. A process as claimed in claim 1 wherein said solvent purified coal is a five type of solvent purified coal useful as a raw material for structurally glassy green coke and characterized by a (N+O+S)/C atomic ratio equal to or greater than 0.0645.

7. A process as claimed in claim 1 wherein the coal is selected from the group consisting of bituminous coal, sub-bituminous coal, brown coal, lignite, and grass peat.

8. A process as claimed in claim 1 wherein the hydrocarbon solvent is selected from the group consisting of fractions obtained from coal-derived heavy oil, petroleum-derived heavy oil, and mixtures thereof by distillation in a temperature range of from 180° to 420° C.

9. A process as claimed in claim 1 wherein the coal is dissolved at a temperature of at least 350° C.

10. A process as claimed in claim 1 wherein said solvent purified coal is subjected to first heat-treatment for a period of not less than 0.5 hour at a temperature equal to or at most 20° C. higher than the temperature employed for the dissolution of the coal to form an intermediate product and said intermediate product is further heated at a higher coking temperature to form said green coke.

11. A process as claimed in claim 10 wherein the temperature employed for the first heat-treatment is in the range of from 370° to 470° C.

12. A process as claimed in claim 10 wherein said coking temperature is in the range of from 420° to 520° C.

13. A process as claimed in claim 9 wherein the coal is heated at a hydrogen pressure of at least 30 $kg/cm^2G$ for a sufficient period of time to form the type of solvent-purified coal useful as a raw material for the desired green coke.

14. A process as claimed in claim 9 wherein the coal is heated, in the presence of water and at a carbon monoxide pressure of at least 30 $kg/cm^2G$ for a sufficient period of time to form the type of solvent purified coal useful as a raw material for the desired green coke.

15. A process as claimed in claim 9 wherein the coal is heated in the presence of at least 3% by weight of stannic chloride based on the weight of the coal.

16. A process as claimed in claim 14 wherein water is used in an amount equal to at least 1 mole per mole of carbon monoxide, and the carbon monoxide is used in an amount, on a dry ash-free weight basis, equal to at least 0.2 part per part of the coal.

* * * * *